US005605170A

United States Patent [19]

Weng

[11] Patent Number: 5,605,170

[45] Date of Patent: Feb. 25, 1997

[54] CRUTCH

[76] Inventor: Kuan-Jen Weng, 58, Ma Yuan West St., Taichung, Taiwan

[21] Appl. No.: 630,862

[22] Filed: Mar. 29, 1996

[51] Int. Cl.[6] ..... A61H 3/02

[52] U.S. Cl. ..... 135/68; 135/69; 135/72

[58] Field of Search ..... 135/68, 65, 69, 135/73, 72, 76, 75

[56] References Cited

U.S. PATENT DOCUMENTS

| | | | |
|---|---|---|---|
| 3,730,198 | 5/1973 | Johnston et al. | 135/73 X |
| 4,637,414 | 1/1987 | Urban | 135/73 |
| 4,865,065 | 9/1989 | Chen | 135/68 X |
| 5,197,502 | 3/1993 | Wang | 135/68 X |
| 5,341,829 | 8/1994 | Hsiao et al. | 135/68 |
| 5,351,701 | 10/1994 | Hsiao | 135/68 |
| 5,402,811 | 4/1995 | Weng | 135/72 X |
| 5,445,175 | 8/1995 | Cho | 135/75 X |

*Primary Examiner*—Lanna Mai

[57] ABSTRACT

A crutch comprises a pad enclosing an arm piece, two bow rods connecting the hollow arm piece longitudinally, a handpiece connecting two bow rods transversely, a pipe clamped by the lower portions of two bow rods, an extensible rod inserted beneath the pipe, a tip cushion covering the lower end of the extensible rod, and a mount confining the lower ends of the pipe and two bow rods. A plug is disposed on the upper end of the pipe. The pipe has a plurality of adjusting holes.

1 Claim, 8 Drawing Sheets

CRUTCH

BACKGROUND OF THE INVENTION

The invention relates to a crutch. More particularly, the invention relates to an assembled crutch without any pin, bolt, screw and rivet.

Referring to FIGS. 1 to 6, a conventional crutch 1 has a pad 11, two bow rods 12 connecting the pad 11 downward, a handpiece 13 connecting two bow rods 12 transversely, a pipe 14 clamped by the lower portions of two bow rods 12, an extensible rod 16 inserted beneath the pipe 14, a tip cushion 17 covering the lower end of the extensible rod 16, and a mount 15 confining the lower ends of the pipe 14 and two bow rods 12. A plug 18 is disposed on the upper end of the pipe 14. Each bow rod 12 has a plurality of positioning holes 120. The pad 11 and the bow rod 12 are fastened by a pin 111 via the corresponding positioning holes 120. A tube 133 is enclosed by the hollow handpiece 13. A bolt 131 and a nut 132 fasten the handpiece 13 and two bow rods 12 together. A rivet 141 fastens the pipe 14 and two bow rods 12 together. Two pins 151 fasten the mount 15, the pipe 14 and two bow rods 12 together. A reinforced rib 142 is disposed between the pipe 14 and the bow rod 12. The pipe 14 has a plurality of adjusting holes 140. However, the conventional crutch 1 has a plurality of pins and rivets in order to assemble the crutch 1. Thus it is very difficult to assemble the crutch 1 for the ordinary users.

SUMMARY OF THE INVENTION

An object of the invention is to provide an assembled crutch which can be assembled without any pin, bolt, screw and rivet.

Another object of the invention is to provide a do-it-yourself crutch which can be assembled by the user.

Accordingly, a crutch comprises a pad enclosing an arm piece, two bow rods connecting the hollow arm piece longitudinally, a handpiece connecting two bow rods transversely, a pipe clamped by the lower portions of two bow rods, an extensible rod inserted beneath the pipe, a tip cushion covering the lower end of the extensible rod, and a mount confining the lower ends of the pipe and two bow rods. A plug is disposed on the upper end of the pipe. The pipe has a plurality of adjusting holes. The hollow arm piece has a plurality of separators therein to reinforce the arm piece. The handpiece has a foamed outer tube with two round openings, an inner tube with two rectangular openings inserted in the outer tube, a spring inserted in the inner tube, and two positioning blocks block two corresponding rectangular openings. Each positioning block has a disk, a lug disposed on the disk, a protuberance disposed on the lug, and a rectangular pivot disposed beneath the disk. Each bow rod has a reinforced rib therein. The reinforced rib has a plurality of positioning holes. The protuberance is inserted in the corresponding positioning hole. A recess is defined by the bow rod and the reinforced rib. A plurality of protruded blocks are disposed on the upper end and lower end of the bow rod. The protruded blocks disposed on the upper end of the bow rod are positioned in the arm piece. The protruded blocks disposed on the lower end of the bow rod are positioned in the mount. The pipe has two lateral flanges to be inserted in the corresponding recesses, respectively. An inserted hole is disposed on the lateral flange to match a piercing hole. An elastic retainer is inserted in the lower end of the bow rod. The elastic retainer has a V-shaped plate with a projection at one end of the V-shaped plate. The projection is inserted in the inserted hole and the piercing hole. The mount has a first and second inner flanges, a middle interior to receive the pipe and two lateral interiors to receive the corresponding bow rods, respectively. Two circular holes are formed on the upper end of the extensible rod. An elastic plate is inserted in the upper end of the extensible rod. The elastic plate has two connecting arms. Each arm has a retaining end inserted in the corresponding circular hole and adjusting hole.

DETAILED DESCRIPTION OF THE INVENTION

Figure 1:
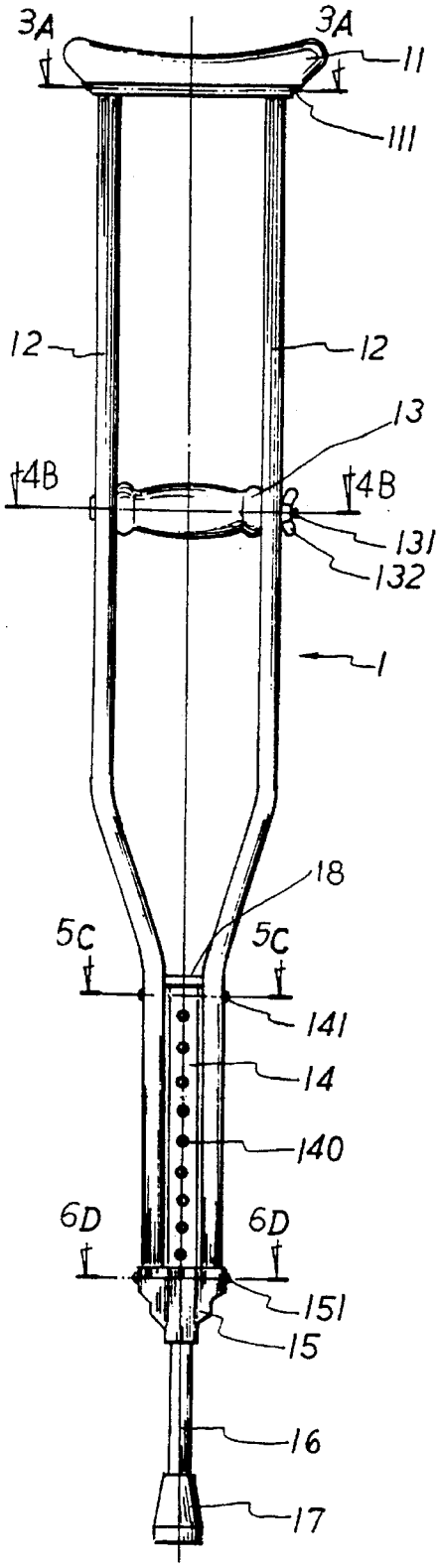
FIG. 1 (PRIOR ART)
FIG. 1 is a front elevational view of a conventional crutch of the prior art.
Figure 2:
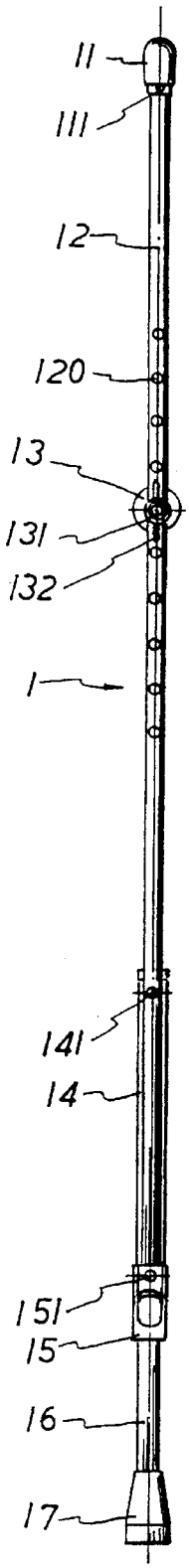
FIG. 2 (PRIOR ART)
FIG. 2 is a side elevational view of FIG. 1.
Figure 3:
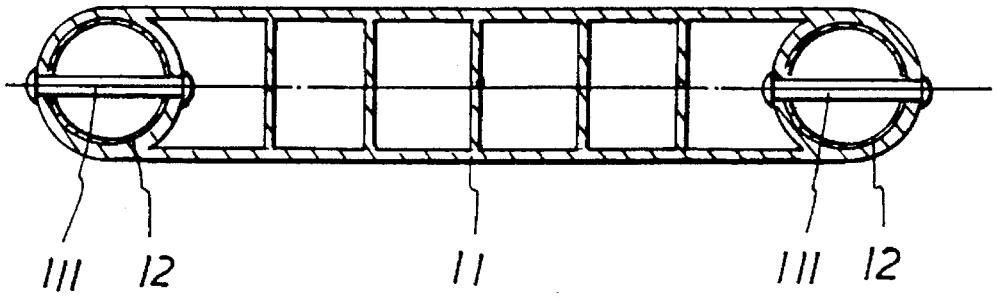
FIG.3 (PRIOR ART)
FIG. 3 is a sectional view taken along line 3A—3A in FIG. 1.
Figure 4:
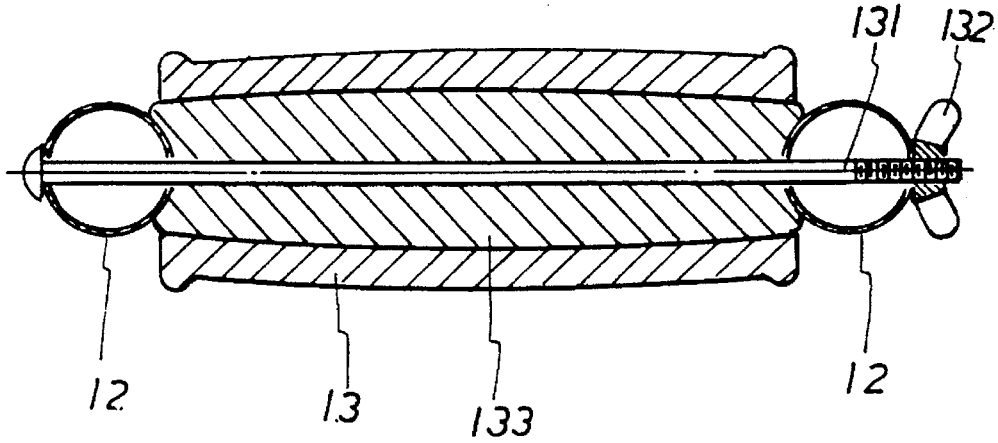
FIG.4 (PRIOR ART)
FIG. 4 is a sectional view taken along line 4B—4B in FIG. 1.
Figure 5:
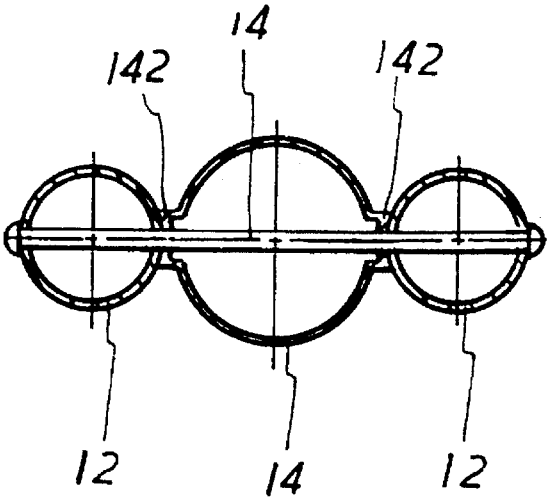
FIG.5 (PRIOR ART)
FIG. 5 is a sectional view taken along line 5C—5C in FIG. 1.
Figure 6:
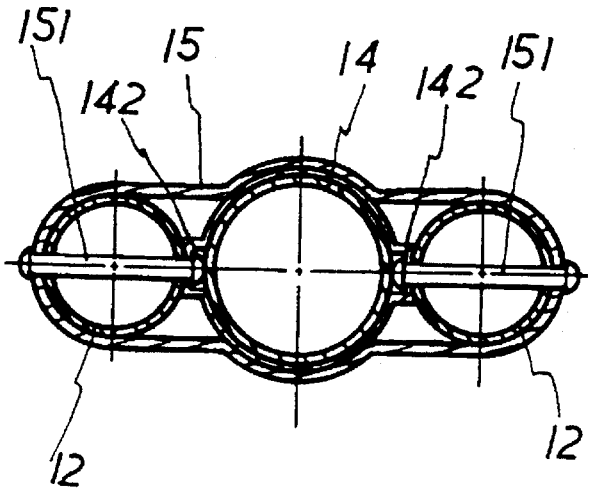
FIG.6 (PRIOR ART)
FIG. 6 is a sectional view taken along line 6D—6D in FIG. 1.
Figure 7:
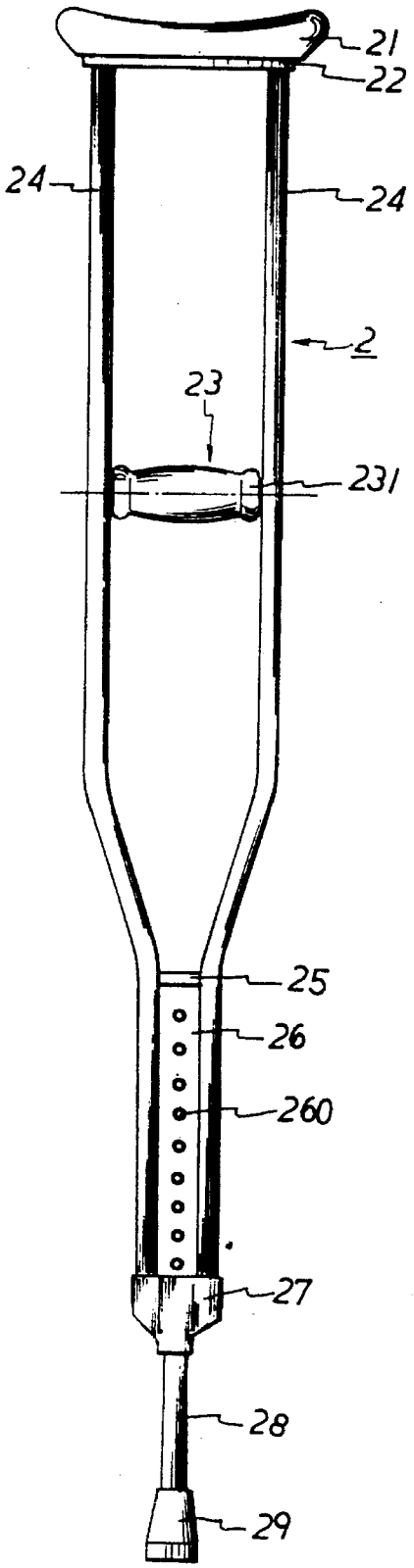
FIG. 7 is a front elevational view of a crutch of a preferred embodiment in accordance with the invention.
Figure 8:
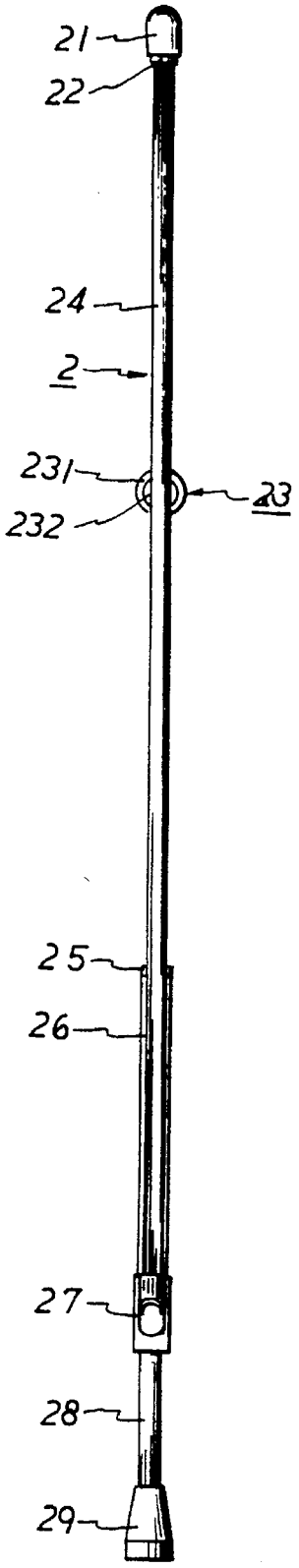
FIG. 8 is a side elevational view of FIG. 7.
Figure 9:
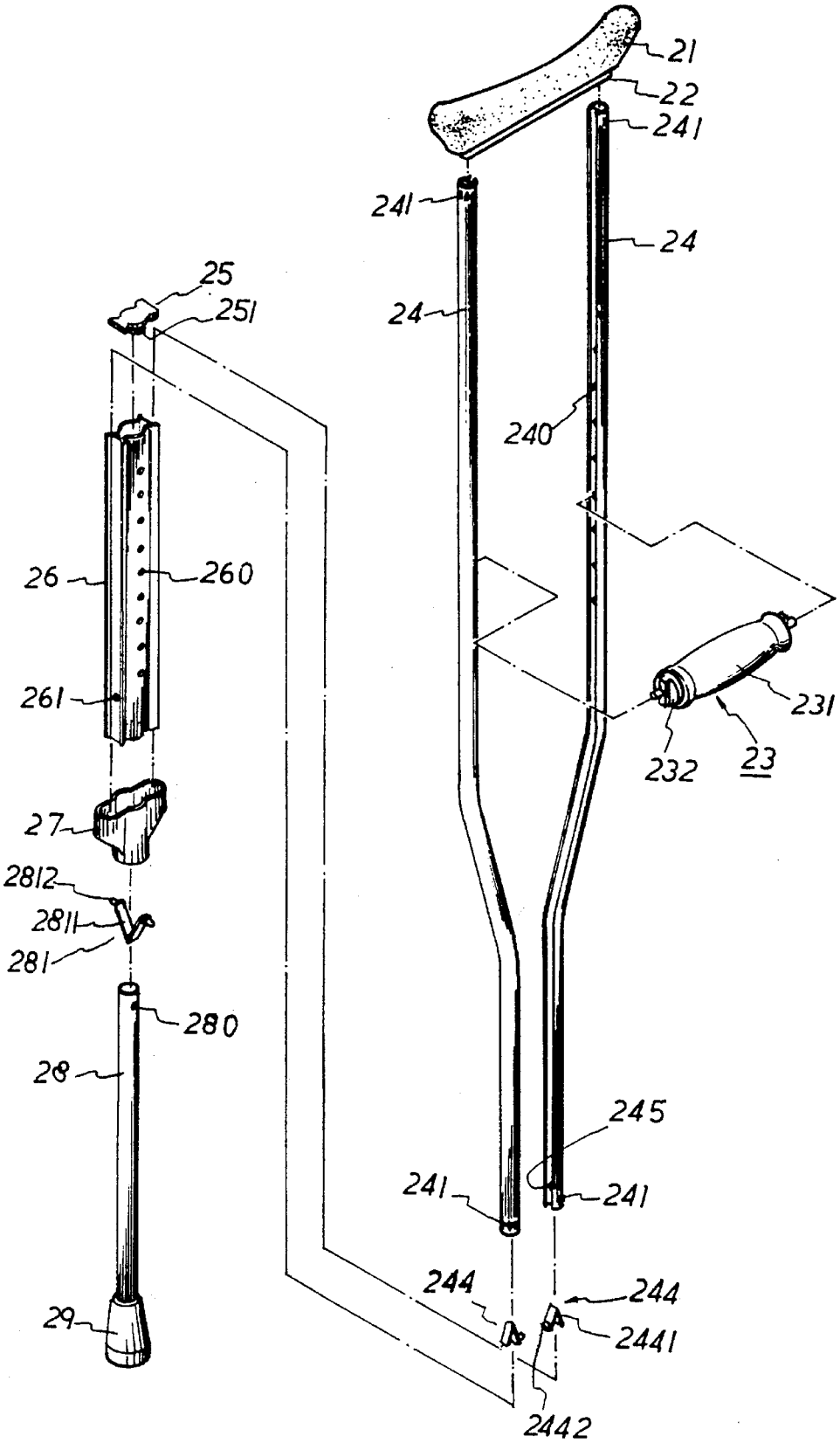
FIG. 9 is a perspective exploded view of a crutch of a preferred embodiment in accordance with the invention.
Figure 10:
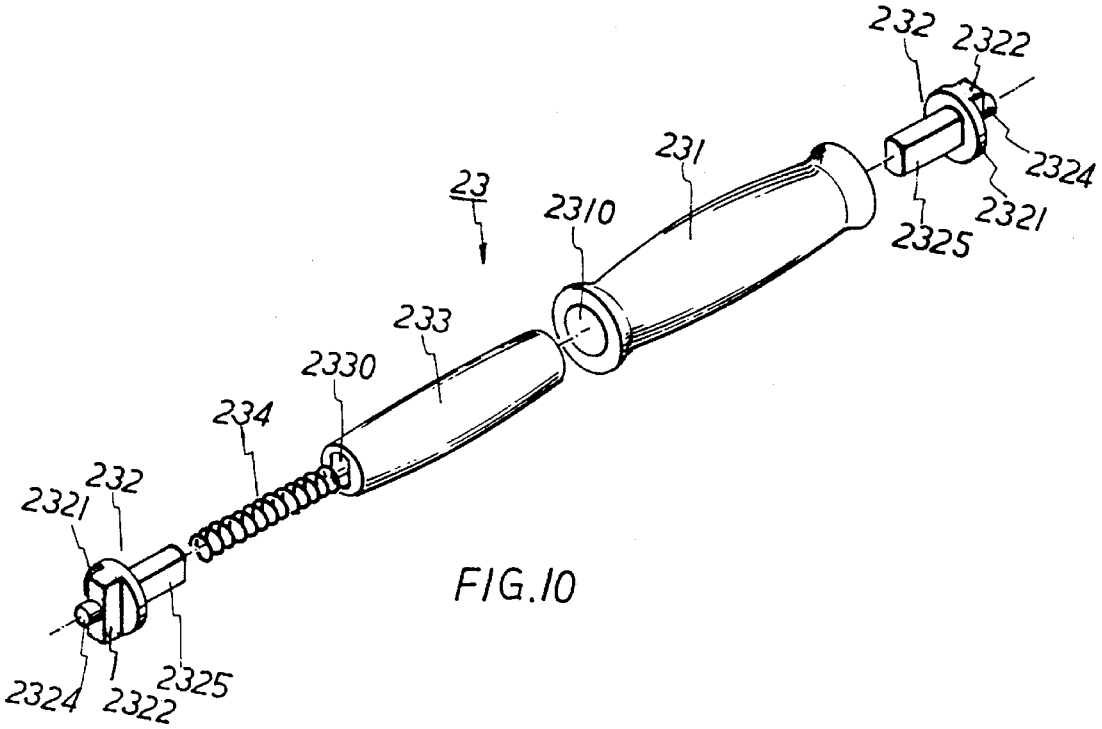
FIG. 10 is a perspective exploded view of a handpiece.
Figure 11:
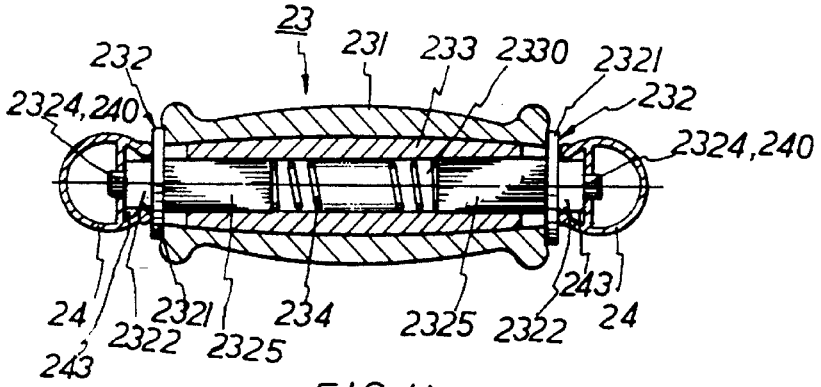
FIGS. 11 and 12 are sectional assembly views of FIG. 10.
Figure 12:
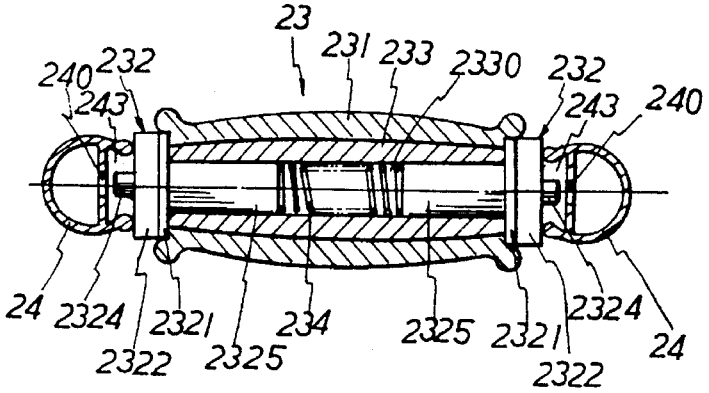
Figure 13:
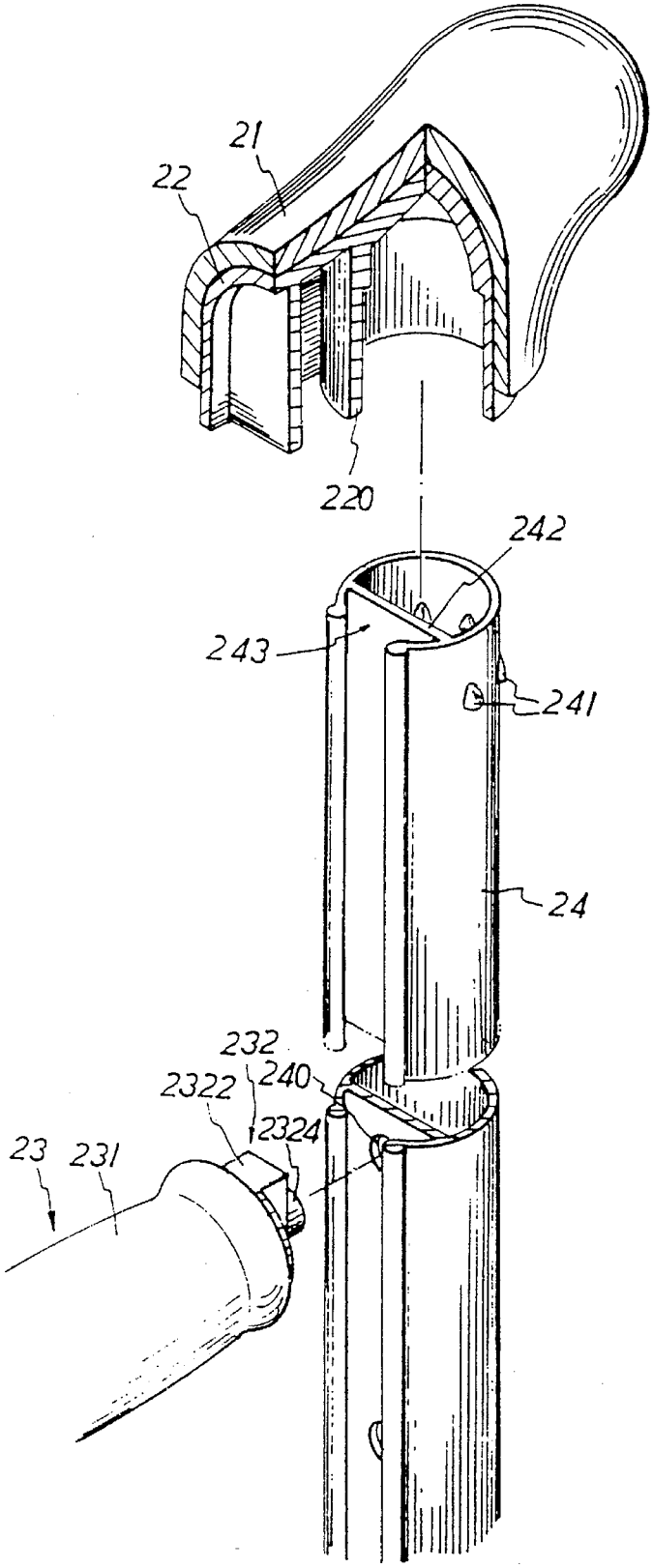
FIG. 13 is a partially perspective exploded view of an arm piece, a handpiece and a bow rod.
Figure 14:
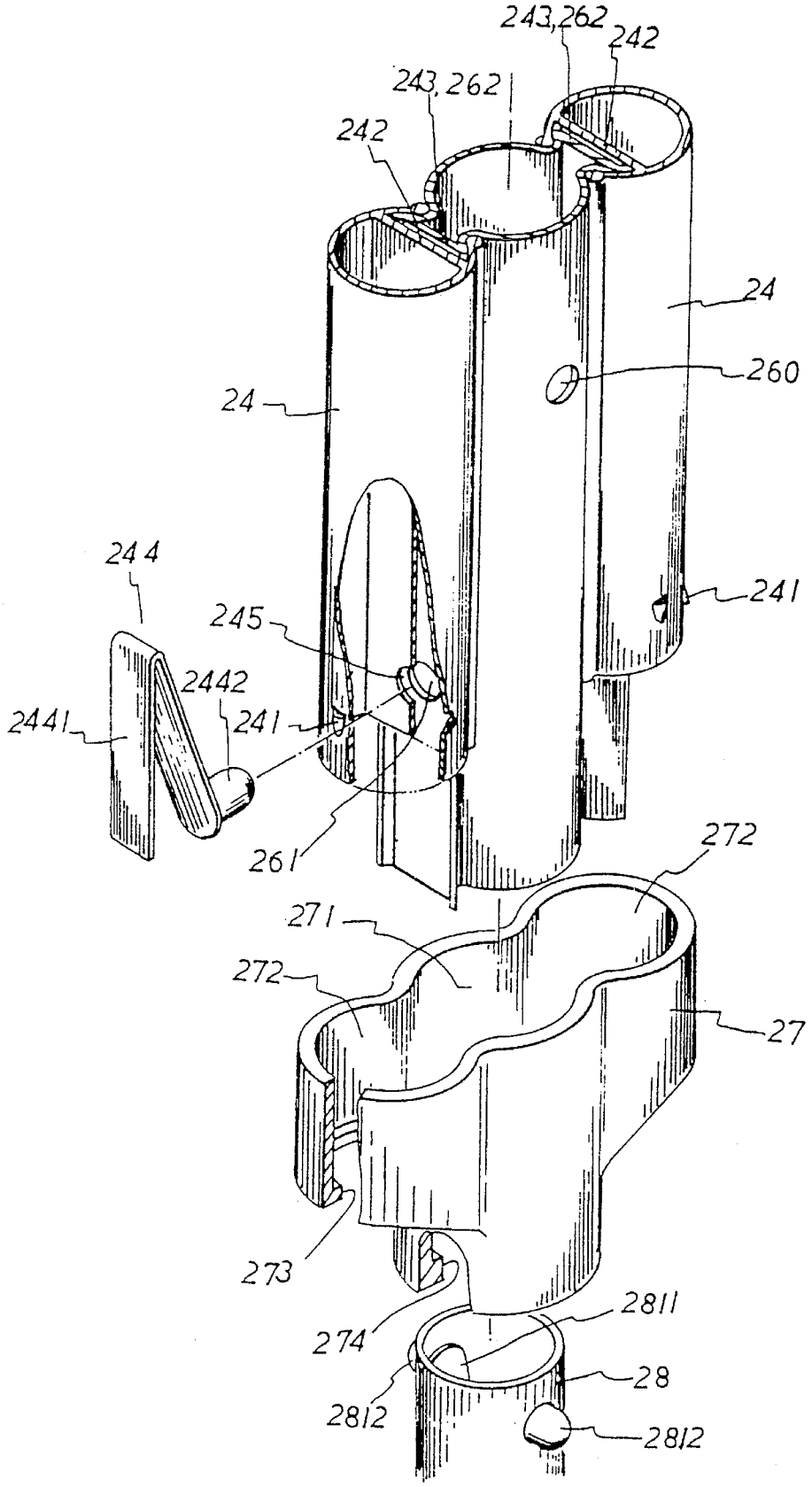
FIG. 14 is a partially perspective exploded view of a bow rod, a mount and an extensible rod.

Referring to FIGS. 7 and 8, a crutch 2 comprises a pad 21 enclosing a hollow arm piece 22, two bow rods 24 connecting the hollow arm piece 22 longitudinally, a handpiece 23 connecting two bow rods 24 transversely, a pipe 26 clamped by the lower portions of two bow rods 24, an upper portion of an extensible rod 28 inserted in the pipe 26, a tip cushion 29 covering the lower end of the extensible rod 28, and a mount 27 confining the lower ends of the pipe 26 and two bow rods 24. A plug 25 with a lower post 251 is disposed on the upper end of the pipe 26. Each bow rod 24 has a plurality of positioning holes 240. The pipe 26 has a plurality of adjusting holes 260.

Referring to FIGS. 7 to 14, the hollow arm piece 22 has a plurality of separators 20 therein to reinforce the arm piece 22. The handpiece 23 has a foamed outer tube 231 with two round openings 2310, an inner tube 233 with two rectangular openings 2330 inserted in the outer tube 231, a spring 234 inserted in the inner tube 233, and two positioning blocks 232 block two corresponding rectangular openings 2330. Each positioning block 232 has a disk 2321, a lug 2322 disposed on the disk 2321, a protuberance 2324 disposed on the lug 2322, and a rectangular pivot 2325 disposed beneath the disk 2321. Each bow rod 24 has a reinforced rib 242 therein. The reinforced rib 242 has a plurality of positioning holes 240. The protuberance 2324 is inserted in the corresponding positioning hole 240. A recess 243 is defined by the bow rod 24 and the reinforced rib 242. A plurality of protruded blocks 241 are disposed on the upper end and lower end of the bow rod 24. The protruded blocks 241 disposed on the upper end of the bow rod 24 are positioned in the arm piece 22. The protruded blocks 241 disposed on the lower end of the bow rod 24 are positioned in the mount 27. The pipe 26 has two lateral flanges 262 to be inserted in the corresponding recesses 243, respectively. An inserted hole 261 is disposed on the lateral flange 262 to match a piercing hole 245. An elastic retainer 244 is inserted in the lower end of the bow rod 24. The elastic retainer 244 has a V-shaped plate 2441 with a projection 2442 at one end of the V-shaped plate 2441. The projection 2442 is inserted in the inserted hole 261 and the piercing hole 245. The mount 27 has a first and second inner flanges 273 and 274, a middle interior 271 to receive the pipe 26 and two lateral interiors 272 to receive the corresponding bow rods 24, respectively. Two circular holes 280 are formed on the upper end of the extensible rod 28. An elastic plate 281 is inserted in the upper end of the extensible rod 28. The elastic plate 281 has two connecting arms 2811. Each arm 2811 has a retaining end 2812 inserted in the corresponding circular hole 280 and adjusting hole 260.

The invention is not limited to the above embodiment but various modification thereof may be made. Further, various changes in form and detail may be made without departing from the scope of the invention.

I claim:

1. An assembled crutch comprising a pad enclosing a hollow arm piece, two bow rods connecting said hollow arm piece longitudinally, a handpiece connecting two bow rods transversely, a pipe with adjusting holes clamped by lower portions of said two bow rods, an upper portion of an extensible rod inserted in said pipe, a tip cushion covering a lower end of said extensible rod, a mount confining lower ends of said pipe and said two bow rods, and a plug with a lower post disposed on an upper end of said pipe, the improvement comprises:

said hollow arm piece having a plurality of separators therein to reinforce said arm piece;

said handpiece having a foamed outer tube with two round openings, an inner tube with two rectangular openings inserted in said outer tube, a spring inserted in said inner tube, and two positioning blocks blocking said two corresponding rectangular openings, respectively;

each said positioning block having a disk, a lug disposed on said disk, a protuberance disposed on said lug, and a rectangular pivot disposed beneath said disk;

each said bow rod having a reinforced rib therein;

said reinforced rib having a plurality of positioning holes;

said protuberance inserted in said corresponding positioning hole;

a recess defined by said bow rod and said reinforced rib;

a plurality of protruded blocks disposed on an upper end and a lower end of said bow rod;

said protruded blocks which are disposed on said upper end of said bow rod positioned in said arm piece;

said protruded blocks which are disposed on said lower end of said bow rod positioned in said mount;

said pipe having two lateral flanges to be inserted in said corresponding recesses, respectively;

an inserted hole disposed on said lateral flange to match a piercing hole;

an elastic retainer inserted in said lower end of said bow rod;

said elastic retainer having a V-shaped plate with a projection at one end of said V-shaped plate;

said projection inserted in said inserted hole and said piercing hole;

said mount having a first and second inner flanges, a middle interior to receive said pipe and two lateral interiors to receive said corresponding bow rods, respectively;

two circular holes formed on an upper end of said extensible rod;

an elastic plate inserted in said upper end of said extensible rod;

said elastic plate having two connecting arms;

each said connecting arm having a retaining end inserted in said corresponding circular hole and said corresponding adjusting hole.

* * * * *